US008728279B2

(12) United States Patent
Tixier

(10) Patent No.: US 8,728,279 B2
(45) Date of Patent: May 20, 2014

(54) LIQUID COMPOSITION SENSOR IN SCALING ENVIRONMENT

(75) Inventor: Sebastien Tixier, North Vancouver (CA)

(73) Assignee: Honeywell ASCA Inc., Mississauga (CA)

( * ) Notice: Subject to any disclaimer, the term of this patent is extended or adjusted under 35 U.S.C. 154(b) by 0 days.

(21) Appl. No.: 13/585,844

(22) Filed: Aug. 15, 2012

(65) Prior Publication Data

US 2012/0304748 A1 Dec. 6, 2012

Related U.S. Application Data

(62) Division of application No. 12/781,827, filed on May 18, 2010.

(60) Provisional application No. 61/235,699, filed on Aug. 21, 2009.

(51) Int. Cl.
*D21C 3/22* (2006.01)
*D21H 21/02* (2006.01)

(52) U.S. Cl.
CPC ..... *D21C 3/226* (2013.01); *D21H 21/02* (2013.01)
USPC ..... 162/263; 205/775; 134/26

(58) Field of Classification Search
CPC ..... G01F 1/64; G01N 27/416; D21C 3/226; D21H 21/02
USPC ..... 162/263; 205/775; 134/26; 73/61.61
See application file for complete search history.

(56) References Cited

U.S. PATENT DOCUMENTS 5,409,571 A * 4/1995 Togo et al. ..... 162/48
6,235,123 B1 * 5/2001 Millar ..... 134/26
6,416,651 B1 * 7/2002 Millar ..... 205/775

OTHER PUBLICATIONS

Bernoulli's Equation [downloaded from archive.org], Feb. 10, 2006 [downloaded online Oct. 4, 2013].*

* cited by examiner

*Primary Examiner* — Anthony Calandra
(74) *Attorney, Agent, or Firm* — Cascio Schmoyer & Zervas

(57) ABSTRACT

Scale formation on the electrode(s) of a liquor sensor can be prevented by continuously delivering a water-soluble scale inhibitor or dispersant into the vicinity of the electrodes of a liquor sensor device. Scale inhibitors include, for instance, polymers that are derived from acrylic acid, maleic acid, acrylamide acid, phosphonate, and combinations thereof. An aqueous mixture of scaling inhibitor continuously delivered to the probe tip of the liquor sensor that was placed in a kraft pulping liquor allowed the sensor to operate accurately for over a month without having to be cleaned of scale.

20 Claims, 2 Drawing Sheets

LIQUID COMPOSITION SENSOR IN SCALING ENVIRONMENT

REFERENCE TO RELATED APPLICATIONS

This application claims priority to U.S. Provisional Application 61/235,699 that was filed on Aug. 21, 2009.

FIELD OF THE INVENTION

The present invention generally relates to methods for inhibiting scale formation in aqueous alkaline systems of chemical pulping processes and particularly to techniques for inhibiting formation, deposition and adherence of calcium salt scale deposits on the electrodes of composition measuring sensors.

BACKGROUND OF THE INVENTION

Pulp making is carried out on large industrial scales worldwide to produce paper. Accordingly it is highly desirable that such pulp making operations be carried out in a cost effective, efficient operation with minimum manufacturing equipment downtime and minimum periods of reduced pulp making process equipment efficiency.

The basic steps in industrial pulp making are to convert plant fiber into chips, convert chips into pulp, wash the pulp, (optionally) bleach the pulp, and transform the pulp into suitable paper which can be used in a variety of paper products.

Typically, several chemical pulping processes are used in industrial pulp making operations. Well known industrial alkaline chemical pulping processes include the Kraft (or sulfate), soda and alkaline sulfite processes. The Kraft process makes the strongest fibers of any pulp producing process and is the most commonly used pulp making process in part due to its efficient recovery process for the cooking chemicals. While the present invention has applicability to any of the above alkaline chemical pulping processes, it is particularly useful with the Kraft process.

In the Kraft process, wood chips are digested to dissolve the lignin that holds the wood fibers together thereby producing clean fibers for further processing into a myriad of paper-based products. The digestion of the wood chips occurs in an alkaline solution mainly consisting of sodium hydroxide and sodium sulfide. As the process proceeds, the hydroxide becomes consumed and the sulfide slowly converts to hydroxide. The resulting pulp fibers are washed and removed leaving a solution, called black liquor, containing the lignin dissolved from the wood chips and residual hydroxide and sulfide. The black liquor is burned in a recovery boiler leaving a smelt primarily consisting of sulfide and sodium carbonate. This smelt is dissolved in water or "weak wash liquor" to produce green liquor. The objective of the remaining steps of the process is to convert sodium carbonate in the green liquor to sodium hydroxide so that the sodium hydroxide can be recycled and reused in the digesting process.

The reaction for converting the sodium carbonate to sodium hydroxide is often referred to as the "causticizing" process or reaction and is carried out in a "slaker" and a series of "causticizers," to produce a white liquor that ideally has a high degree of sodium hydroxide and only a small amount of sodium carbonate. The causticizing reaction is controlled by the amount of lime (calcium oxide) introduced to the slaker and the flow rate of green liquor into the slaker. To produce white liquor having the appropriate characteristics, the flow rate of lime into the slaker is carefully regulated. It is essential to measure the characteristics of the green liquor and/or the white liquor in order to control the causticizing reaction.

Various types of sensor devices have been used to monitor and control the composition of green and white liquor. For example, the sensor device can comprise a series of electrodes embedded in housing mounted inside a digester or recausticizing tank. Unfortunately, calcium scales develop rapidly on the electrodes in such hostile environments resulting in measurement drift and loss of accuracy. The sensor devices must be physically cleaned to remove the scales. U.S. Pat. No. 6,235,123 to Millar describes a sensor device in which the electrodes are embedded in the surface of a housing that is equipped with a cleaning baffle. When cleaning is required, the cleaning baffle is rotated from a first position adjacent the electrodes, where the baffle does not interfere with contact between the liquor and the electrodes, to a second position, so that the baffle covers the electrodes from the liquor. Thereafter, a cleaning solvent is directed under pressure to the electrodes through a solvent channel. The spraying action is said to remove built-up materials on the electrodes. This in-situ cleaning technique has proven not to be effective in hostile environments in part because during the frequent cleaning cycles, the position of the baffles over the electrodes result in significant down times where the sensor device is not operating.

SUMMARY OF THE INVENTION

The present invention is based in part on the demonstration that scale formation on the electrode(s) of a liquor sensor can be drastically reduced by continuously delivering a water-soluble scale inhibitor or dispersant into the vicinity of the electrodes of a liquor sensor device. Preferred scale inhibitors are suitable polymers that include, for example, acrylic acid polymer, maleic acid polymer, acrylamide acid polymer, phosphonate polymer, and combinations thereof. The presence of the scale inhibitor does not interfere with the measurements by the liquor sensor. Multi-electrode composition measuring devices employing the inventive technique are able to continuously function accurately for over a month period without having to be removed from the liquor and physically cleaned. Without the water-soluble scale inhibitor, the same measuring devices must be cleaned every few days.

In one aspect, the invention is directed to a system for measuring at least one component that includes NaOH, $Na_2S$, and $Na_2CO_3$ in a kraft pulping liquor that has a pH of at least 8.5 that includes:

a sensor device having at least one electrode that is configured to be positioned in the pulping liquor;

a source of an aqueous mixture of scaling inhibitors; and means for continuously distributing an effective amount of the aqueous mixture of scaling inhibitors into the pulping liquor in the vicinity of the at least one electrode, characterized in that scale deposition in the form of calcium salts that are present in the pulping liquor onto the at least one electrode is effectively controlled to permit continuous operation of the sensor device for more than a month without cleaning. In one embodiment, the sensor device has at least one electrode that is configured to be positioned in the liquid. In another embodiment, the at least one electrode is mounted within a housing and an effective amount of the scaling inhibitors is released into the liquid toward the vicinity of the at least one electrode. In a further embodiment, the aqueous mixture of scaling inhibitors is not applied directly onto the at least one electrode.

In another aspect, the invention is directed to a method of inhibiting the formation of scale on an electrode of a pulp liquor sensor device that measures at least one component that includes NaOH, $Na_2S$, and $Na_2CO_3$ in a kraft pulp liquor that includes the steps of:

immersing the electrode of the sensor device into a kraft pulp liquor that has a pH of at least 8.5;

providing a source of an aqueous mixture of scaling inhibitors; and continuously distributing an effective amount of the aqueous mixture of scaling inhibitors into the kraft pulp liquor in the vicinity of the electrode characterized in that scale deposition in the form of calcium salts that are present in the pulping liquor onto the electrode is effectively controlled to permit continuous operation of the sensor device for more than a month without cleaning

DETAIL DESCRIPTION OF PREFERRED EMBODIMENTS

Figure 1:
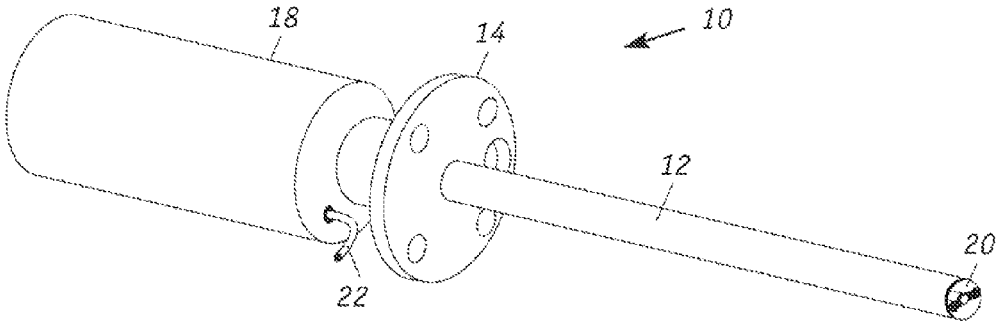
FIG. 1 illustrates a liquor sensor for measuring the composition of pulping liquors.

As shown in FIG. 1, the liquor sensor apparatus 10 comprises a multi-electrode composition measuring device that includes a probe tip assembly 12, mounting bracket 14, and rear assembly 18. The sensor apparatus is particularly suited for measuring the concentrations of NaOH, $Na_2S$, $Na_2CO_3$ and/or other active chemicals that are present in liquor composition. A suitable multi-electrode unit is described in U.S. Pat. No. 6,416,651 to Millar, which is incorporated herein by reference (referred to herein as the "Millar patent'). The Millar Patent provides a method and apparatus for measuring liquor components, such as those in the green liquor and white liquor which result during a causticizing process. These measurements can be used to achieve more effective control of the causticizing or other (i.e. digestive) reaction for the production of white liquor or other desired output products (e.g., pulp consistency, degree of digestion, etc.). The Millar patent further allows measurement of each relevant component of each of the liquors to occur concurrently. These results are achieved in a system that continuously measures the stream of liquor as opposed to sampling the liquor stream, and is effective even in the face of changing process parameters, such as pH, temperature, unknown impurities and other factors which influence concentration measurements. Further, the Millar Patent allows durable sensor components to be used which would otherwise be non-ideal due to their difficulty in maintaining a stable voltage. The Millar patent comprises the following steps. At a first electrode, a varying voltage is supplied in a voltage range including the half-wave potential of each component of a liquor to be measured, and accounting for variations in the half-wave potential caused by changing process parameters. At a second electrode, which can be roughly ⅓to ¼the size of the first electrode, the derivative of current intensity is monitored near the known half-wave potential for the various liquor components. Using look-up tables, iterative curve-fitting means or other methods, the derivative of current intensity and selected other process condition data is used to determine concentrations of the various liquor components. Probe tip assembly 12, which is typically 1-2meters in length, positions the probe tip 20 a short distance into a process vessel of the pulping process so as to be in contact with the liquor to be measured. Rear assembly 18 can include a reservoir that contains an aqueous mixture of a scaling inhibitor. The height of the reservoir within the rear assembly, relative to the probe tip 20, allows the scaling inhibitor to pass into the liquor by gravity; however, where necessary, pumps can be employed to regulate the flow rate into the liquor. Wires 22 connect probe tip 20 to a computer (not shown).

Figure 2:
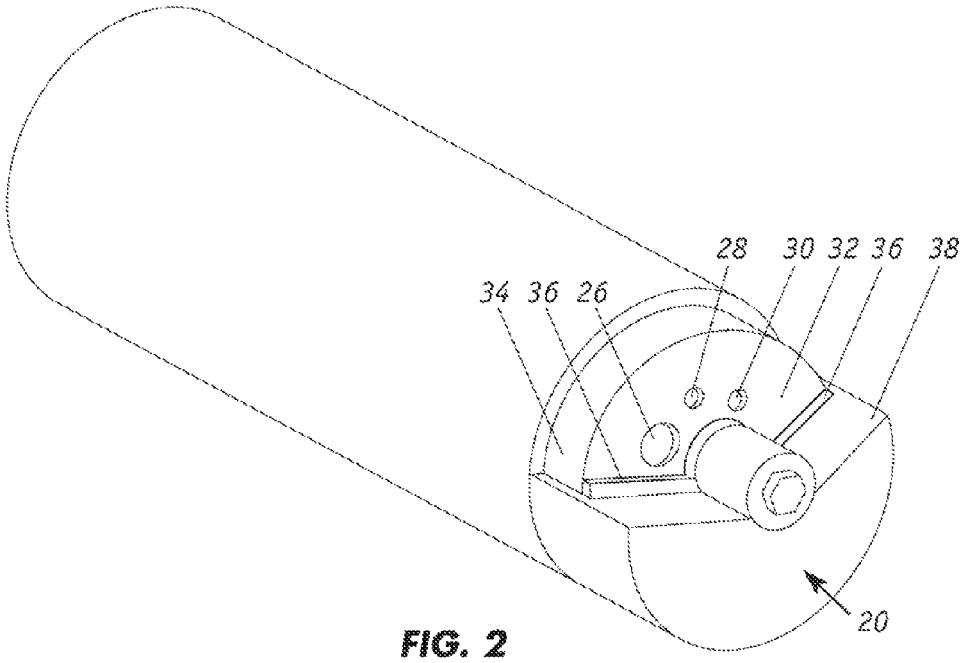
FIG. 2 is an enlarged view of the probe tip.

FIG. 2 shows probe tip 20 configured with the external surfaces of electrodes 26, 28 and 30 being substantially flush with surface 32 of housing 34. The electrodes are preferably located on one side of housing 34 and on the opposite side is aperture 36 through which a mixture of scaling inhibitors exits. The contour of vertical wall 38 that projects from housing 34 is configured to flank the electrodes. In this fashion, the aqueous mixture of scaling inhibitors exiting aperture 36 will be directed toward the electrodes. The exterior components of liquor sensor apparatus 10 are preferably made of corrosion resistant metal such as, for example, stainless steel. Similarly, the electrode tips that are exposed in the liquor composition are preferably made of platinum. In an embodiment shown in the Millar Patent, one larger electrode, and two smaller electrodes lie in a common surface of the probe tip. The larger electrode is used as secondary electrode and may be three to four times the size of the remaining two electrodes. This physical configuration ensures that working electrode, and not secondary electrode, limits current flow through the measurement system. Further, keeping working electrode small reduces the energy required to excite the measured liquor and produce a measurement. The small size of the working electrode also reduces the amount of current required to operate the measurement system, minimizing errors caused by solution and wiring resistance. As further described in the Millar patent, if reference electrode is implemented, it is located as close as practical to working electrode. Further, while not crucial, the three electrodes should be mounted in the same plane. This configuration best defines the current path between the electrodes, and eliminates errors that could otherwise be caused by streaming flows in other configurations.

Figure 3:
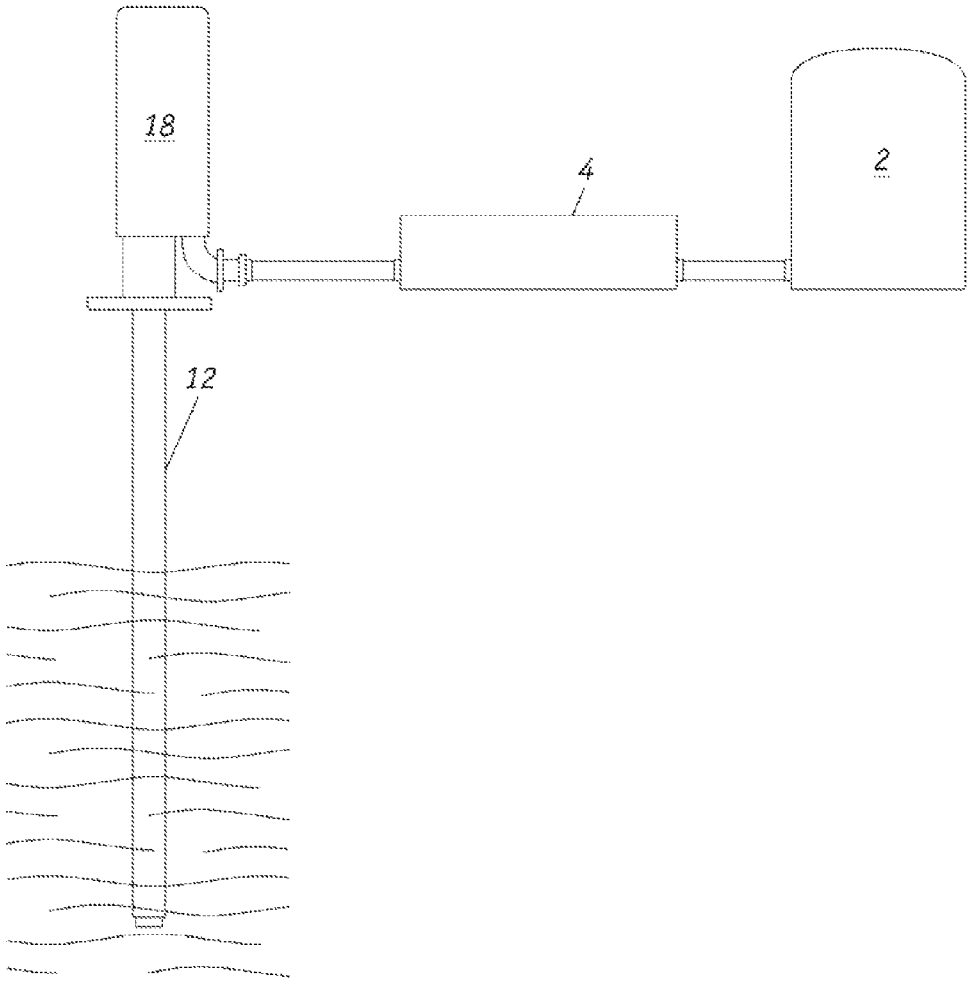
FIG. 3 illustrates a system for measuring the composition of pulping liquors that is equipped with a continuous source of scale inhibitors.

As shown in FIG. 3, rear assembly 18 is connected to a source of scaling inhibitor 2. A pump 4 that is regulated by a controller (not shown) delivers the scale inhibitor mixture to the rear assembly 18. The mixture then flows through probe tip assembly 12 and into the liquid in the vicinity of the electrodes at the probe tip 20 (FIG. 2). A continuous stream of the mixture is metered out from probe tip 20 that is immersed in the liquor. With the present invention, it is not necessary to apply the scale inhibitor mixture under pressure directly onto the electrode surfaces. Moreover, the electrodes are not shielded nor covered with any baffle from the liquor during any cleaning phase, in other words, the electrodes operate continuously and there is no downtime of the composition-measuring device. The present invention is particularly suited for measuring the compositions in the white liquor and green liquor in the kraft process, which is further described, for instance, in U.S. Pat. Application Publication 2009/0255829 to Tixier et al. and U.S. Pat. No. 5,822,220 to Baines, which are both incorporated by reference.

Suitable scaling inhibitors prevent scale from depositing onto the electrodes and other surfaces of the probe tip. The types of scale that can be prevented from being deposited include, for example, calcium carbonate ($CaCO_3$) and personite ($Ca_xNa_yCO_3$). Preferred scale inhibitors are suitable polymers include, for instance, acrylic acid polymer, maleic acid polymer, acrylamide acid polymer, phosphonate polymer and combinations thereof. Chemicals for use as scaling inhibitors are commercially available, for instance, from Kemira Oyj (Finland). A preferred source is FENNODISPO 5300 from Kemira, which is an aqueous acrylic polymer. Active ingredients sold under the BELCLENE line of products from BWA Water Additives UK Limited (UK) are also suitable. For example, BELCLENE 200, which has maleic homopolymers, BELCLENE 283, which has maleic terpolymers, and BELCLENE 110, which has carboxylic acid based polymers, can be employed.

Suitable scaling inhibitors are typically prepared by diluting the chemicals with sufficient amounts of water to form aqueous mixtures containing about 1 to 10% active components. In use, the mixture is continuously metered through the aperture in the probe tip at a flow rate of from 1 ml/min to approximately 5 to 10 ml/min to generate 1 to 50 ppm of actives in the vicinity of the electrodes of the probe tip.

It has been demonstrated that scaling will adversely affect the accuracy of a liquor sensor after just one day of measurement in a hostile pulp liquor environment. However, when an aqueous mixture of scaling inhibitor formulated from FENNODISPO 5300 was employed and continuously delivered to the probe tip of the liquor sensor, the sensor operated accurately for over a month without having to be cleaned of scale.

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A system for measuring a component in a kraft pulping, liquor that has a pH of at least 8.5 that comprises:

a sensor device having a first electrode and a second electrode that are neither shielded nor covered with a baffle and that are configured to be positioned in the kraft pulping liquor wherein the sensor device measures the amount of NaOH, $Na_2S$, and/or $Na_2CO_3$ in the kraft pulping liquor wherein the sensor device has an aperture opposite the first electrode and the second electrode;

a controller operative to supply a varying current to the first electrode wherein the second electrode receives a current from the first electrode and wherein the sensor device generates signals corresponding to the amount of NaOH, $Na_2S$, and/or $Na_2CO_3$ in the kraft pulping liquor;

a reservoir containing an aqueous mixture of polymer scaling inhibitors; and a pump that continuously delivers an effective amount of the aqueous mixture of polymer scaling inhibitors through the aperture into the liquor in the vicinity of the first electrode and the second electrode with the proviso that the aqueous mixture of polymer scaling inhibitors is not applied directly to the first electrode or the second electrode, characterized in that the presence of the polymer scale inhibitors does not interfere with measurement by the sensor device and scale deposition in the form of salts that are present in the liquor onto the first electrode and second electrode is inhibited as current flows from the first electrode to the second electrode which permits continuous operation of the sensor device for more than a month without cleaning.

2. The system of claim 1 wherein the polymer scaling inhibitors are polymers consisting of acrylic acid polymers, maleic acid polymers, acrylamide acid polymers, phosphonate polymers or mixtures thereof.

3. The system of claim 1 wherein the polymer scaling inhibitors comprise a mixture of polymers that are derived from acrylic acid and maleic acid.

4. The system of claim 1 wherein the pump continuously delivers the aqueous mixture of polymer scaling inhibitors that release active scaling inhibitors into the vicinity of the first electrode and second electrode to maintain a concentration of at least 1 ppm actives.

5. The system of claim 4 wherein the concentration ranges from 1 to 50 ppm actives.

6. The system of claim 1 wherein the varying current is supply in a voltage range to the first electrode.

7. The system of claim 1 comprising a current sensing device operative to detect a current intensity of the second electrode.

8. The system of claim 1 wherein the sensor device further includes a reference electrode that provides a reference potential for the second electrode.

9. A system for measuring a component in a kraft pulping liquor that has a pH of at least 8.5 that comprises:

a sensor device having a probe tip with a first electrode and a second electrode that are neither shielded nor covered with a baffle wherein the probe tip is configured to be positioned in the kraft pulping liquor and wherein the sensor device measures the amount of NaOH, $Na_2S$, and/or $Na_2CO_3$ in the kraft pulping liquor and wherein the probe tip has an aperture opposite the first electrode and second electrode;

a controller operative to supply a varying current to the first electrode wherein the second electrode receives a current from the first electrode and wherein the sensor device generates signals corresponding to the amount of NaOH, $Na_2S$, and/or $Na_2CO_3$ in the kraft pulping liquor; and a reservoir containing an aqueous mixture of polymer scaling inhibitors wherein the reservoir is in an elevated position relative to the probe tip such that the aqueous mixture of polymer scaling inhibitors flows by gravity from the reservoir to the probe tip to continuously deliver an effective amount of the aqueous mixture of polymer scaling inhibitors through the aperture into the liquor in the vicinity of the first electrode and the second electrode with the proviso that the aqueous mixture of polymer scaling inhibitors is not applied directly to the first electrode or the second electrode, characterized in that the presence of the polymer scale inhibitors does not interfere with measurement by the sensor device and scale deposition in the form of salts that are present in the liquor onto the first electrode and second electrode is inhibited as current flows from the first electrode to the second electrode which permits continuous operation of the sensor device for more than a month without cleaning.

10. The system of claim 9 wherein the polymer scaling inhibitors are polymers consisting of acrylic acid polymers, maleic acid polymers, acrylamide acid polymers, phosphonate polymers or mixtures thereof.

11. The system of claim 9 wherein the polymer the scaling inhibitors comprise a mixture of polymers that are derived from acrylic acid and maleic acid.

12. The system of claim 9 wherein the aqueous mixture of polymer scaling inhibitors that is continuously delivered releases active scaling inhibitors into the vicinity of the first electrode and second electrode is effective to maintain a concentration of at least 1 ppm actives.

13. The system of claim 12 wherein the concentration ranges from 1 to 50 ppm actives.

14. The system of claim 9 wherein the varying current is supplied in a voltage range to the first electrode.

15. The system of claim 9 comprising a current sensing device operative to detect a current intensity of the second electrode.

16. The system of claim 9 wherein the sensor device further includes a reference electrode that provides a reference potential for the second electrode.

17. A system for measuring a component in a kraft pulping liquor that has a pH of at least 8.5 that comprises:

a sensor device having a probe tip with a plurality of electrodes including a first electrode and a second electrode that are neither shielded nor covered with a baffle and wherein the probe tip is configured to be positioned in the kraft pulping liquor wherein the probe tip has an aperture opposite the first electrode and second electrode and wherein the sensor device measures the amount of NaOH, $Na_2S$, and/or $Na_2CO_3$ in the kraft pulping liquor;

a controller operative to supply a varying current in a voltage range to the first electrode wherein the second electrode receives a current from the first electrode and wherein the sensor device generates signals corresponding to the amount of NaOH, $Na_2S$, and/or $Na_2CO_3$ in the kraft pulping liquor; and a reservoir containing an aqueous mixture of polymer scaling inhibitors, an effective amount of which is continuously delivered through the aperture into the liquor in the vicinity of the first electrode and the second electrode, with the proviso that the aqueous mixture of polymer scaling inhibitors is not applied directly to the first electrode or the second electrode, characterized in that the presence of the polymer scale inhibitors does not interfere with measurement by the sensor device and scale deposition in the form of salts that are present in the liquor onto the first electrode and second electrode is inhibited as current flows from the first electrode to the second electrode which permits continuous operation of the sensor device for more than a month without cleaning and the polymer scaling inhibitors are delivered only when the controller operative to supply a varying current to the first electrode is activated.

18. The system of claim 17 wherein the polymer scaling inhibitors are polymers consisting of acrylic acid polymers, maleic acid polymers, acrylamide acid polymers, phosphonate polymers or mixtures thereof.

19. The system of claim 17 wherein the polymer scaling comprise a mixture of polymers that are derived from acrylic acid and maleic acid.

20. The system of claim 17 wherein the sensor device further comprises a reference electrode that provides a reference potential to the second electrode and the system comprises a current sensing device operative to detect a current intensity of the second electrode.

* * * * *